US006248230B1

(12) United States Patent
Min et al.

(10) Patent No.: US 6,248,230 B1
(45) Date of Patent: Jun. 19, 2001

(54) METHOD FOR MANUFACTURING CLEANER FUELS

(75) Inventors: Wha-Sik Min; Kyung-Il Choi; Sin-Young Khang; Dong-Soon Min; Jae-Wook Ryu; Kwan-Sik Yoo; Jyu-Hwan Kim, all of Taejon (KR)

(73) Assignee: SK Corporation, Seoul (KR)

( * ) Notice: Subject to any disclaimer, the term of this patent is extended or adjusted under 35 U.S.C. 154(b) by 0 days.

(21) Appl. No.: 09/339,639

(22) Filed: Jun. 24, 1999

(30) Foreign Application Priority Data

Jun. 25, 1998 (KR) ..... 98-24122
Jun. 25, 1998 (KR) ..... 98-24123
Apr. 28, 1999 (KR) ..... 99-15290

(51) Int. Cl.[7] ..... C10G 67/04; C10G 67/06

(52) U.S. Cl. ..... 208/213; 208/87; 208/91; 208/211; 208/254 H

(58) Field of Search ..... 208/87, 91, 108, 208/211, 213, 254 R

(56) References Cited

U.S. PATENT DOCUMENTS

| | | | |
|---|---|---|---|
| 3,954,603 | 5/1976 | Curtin | 208/253 |
| 4,033,861 | 7/1977 | Holloway et al. | 208/211 |
| 4,176,047 | 11/1979 | Orrell et al. | 208/51 |
| 4,269,694 | 5/1981 | Holland et al. | 208/48 |
| 4,343,693 | 8/1982 | Holland et al. | 208/244 |
| 4,344,841 | 8/1982 | Johnson et al. | 208/211 |
| 4,409,421 | 10/1983 | Herwig et al. | 585/833 |
| 4,488,953 * | 12/1984 | Tang et al. | 204/163 R |
| 4,795,545 | 1/1989 | Schmidt | 208/91 |
| 4,912,873 | 4/1990 | Diaz et al. | 44/57 |
| 5,082,987 | 1/1992 | Olbrich et al. | 585/737 |
| 5,120,881 | 6/1992 | Rosenfeld et al. | 568/697 |
| 5,264,187 | 11/1993 | Olbrich et al. | 422/190 |
| 5,271,834 | 12/1993 | Mondiny | 210/222 |
| 5,300,218 | 4/1994 | Graiff et al. | 208/209 |
| 5,336,834 | 8/1994 | Zarchy et al. | 585/737 |
| 5,454,933 | 10/1995 | Savage et al. | 208/212 |
| 5,516,963 | 5/1996 | Zarchy et al. | 585/737 |
| 5,730,860 | 3/1998 | Irvine | 208/213 |
| 5,858,028 * | 1/1999 | Davies et al. | 44/393 |

* cited by examiner

*Primary Examiner*—Bekir L. Yildirim
(74) *Attorney, Agent, or Firm*—Drinker Biddle & Reath LLP

(57) ABSTRACT

A method is provided for manufacturing cleaner fuels, in which NPC (Natural Polar Compounds), naturally existing in small quantities within various petrolic hydrocarbon fractions, are removed from the petrolic hydrocarbon fractions ranging, in boiling point, from 110 to 560° C. and preferably from 200 to 400° C., in advance of catalytic hydroprocessing. The removal of NPC improves the efficiency of the catalytic process and produces environment-friendly products, such as diesel fuel with a sulfur content of 50 ppm (wt) or lower. Also, the NPC can be used to improve fuel lubricity.

22 Claims, 4 Drawing Sheets

METHOD FOR MANUFACTURING CLEANER FUELS

FIELD OF THE INVENTION

The present invention relates, in general, to a method for manufacturing a cleaner fuel and, more particularly, to the removal of NPC (Natural Polar Compounds) from petroleum hydrocarbon feedstocks ranging, in boiling point, from 110 to 560° C., in advance of a catalytic hydroprocessing process. The removal of NPC improves the efficiency of the catalytic process and produces environmentally favorable petroleum products, especially diesel fuel with a sulfur content of below 50 ppm (wt) by deep hydrodesulfurization. Also, the present invention suggests the usage of such NPC to improve fuel lubricity.

DESCRIPTION OF THE PRIOR ART

The ever-worsening environmental pollution problem, especially air quality degradation, has brought stringent environmental regulatory policies throughout the world, and developed countries are imposing tight quality regulations upon transportation fuels. Of such fuels, diesel fuel is considered to be a major contributor of such harmful pollutants as $SO_x$, $NO_x$ and PM (particulate matter). The most severe regulatory standards are being applied to diesel fuels.

While such diesel quality specifications as sulfur content, aromatics content, polyaromatics content, cetane number, T95 (95% distillation temperature), density and viscosity are known to affect generation of the aforementioned pollutants, sulfur content has become the most critical issue because it forms sulfur dioxide when combusted. Further, a portion of sulfur dioxide is readily converted to sulfur trioxide, which, with moisture, forms PM. Besides contributing to the formation of PM, sulfur-containing compounds such as sulfur dioxide and sulfate harm automobile emission after-treatment devices by poisoning the noble metal catalysts therein.

Recently, automobile manufacturers have claimed that the sulfur content of diesel fuel should be reduced to below 30 ppm (wt) for their new diesel engines to meet the future tail-pipe emission regulations. Consequently, a ULSD (ultra low sulfur diesel) market is now emerging, especially in Western Europe. Eventually, such fuels are expected to replace the conventional 500 ppm sulfur diesel fuel market.

In keeping up with the tightening regulations, oil companies have been making large investments to produce environment-friendly petroleum products, for example, by revamping existing facilities or installing new processes. From an economic standpoint, however, neither existing nor newly developed processes thus far appear to be economically feasible under the current price structure of petroleum products. Therefore, the United States and many countries in Western Europe have implemented refiner-inducing policies such as tax incentives, which reimburse additional costs incurred in producing cleaner fuels.

An HDS (hydrodesulfurization) process is most commonly used to reduce sulfur content from diesel fuel by converting sulfur compounds into hydrogen sulfide. In the late 1950's, the HDS process was first introduced as a pretreatment for the naphtha reforming process since catalysts were prone to poisoning by sulfur compounds. Since then, various HDS processes have been developed and an HDS process for LGO (light gas oil) appeared in the 1960's. Nowadays, most refineries are equipped with HDS processes, and statistics show that, in 1994, the unit capacity of kerosene and LGO HDS processes in the world amounted to 21% of the crude distillation units.

Many of the HDS processes currently being used by refiners are non-licensed processes, and most of the related patents pertain to catalyst preparation and modification. Generally, when the process variables are properly modified and suitable catalysts are selected, diesel fuel with 0.1 weight percent of sulfur can be produced. In order to reduce the sulfur content below 50 ppm, however, innovative improvement in terms of the following operating parameters is required: catalyst activity, reaction temperature, bed volume and hydrogen partial pressure.

Catalyst activity has been doubled since the first generation LGO HDS catalyst was introduced in the late 1960's. However, the activity has to be further improved to attain deep HDS to desired levels. Deep HDS is understood herein to refer to hydrodesulfurization rates greater than 95%. An improved activity, by a factor of 3.2, compared to that of the first generation catalyst, is required to reduce the sulfur content from 2,000 ppm to 500 ppm, and an improvement in activity by a factor of 17.6 is needed to reach the 50 ppm level. This means that unless the catalyst activity is dramatically improved, the number of reactors must be increased or the charge rate must be decreased to achieve deep HDS. To make matters worse, the catalysts are getting more and more expensive because of the increase in the amount of impregnated metals employed in the catalysts and the sophisticated modification of support structure, while catalyst lifetime is reduced to ½~⅕ of conventional catalysts, as reaction conditions get severe.

Reaction temperatures may be increased to reduce the sulfur content. However, since most HDS processes were designed for a 0.2% sulfur level, the furnace and the reactor cannot be operated exceeding the design limits. In addition, increase in temperature results in product color degradation and/or reduction in catalyst life.

In the past, many refiners opted to install additional reactors to meet the regulatory standards because it seemed to be a simple and straightforward approach. However, only a finite number of reactors can be added because there exist space limitations, pressure drop considerations across reactors, and huge capital costs for additional reactors and compressors.

Increasing the pressure of reactors, as mentioned previously, could be another alternative. Yet, the revamp costs for high pressure reactors, compressors, pumps and heat exchangers are significantly high, not to mention the hydrogen consumption increase.

Besides sulfur, it has long been disputed whether the aromatics content should be a part of the quality standards of diesel fuel. Nevertheless, automotive diesel fuels with low aromatic content are already manufactured and sold regionally in the United States and Northern Europe. To saturate aromatic compounds, however, a large amount of hydrogen is necessary with noble metal catalysts, and energy consumption also increases noticeably. In addition, the use of noble metal catalysts requires an additional HDS process preceding the catalytic hydrotreating process in order to prevent sulfur and nitrogen compounds from deactivating the catalysts.

Of the catalytic hydroprocessing processes that are designed to produce cleaner diesel fuels from LGO by removing sulfur and aromatic compounds, only a few of them are commercially available, and they can be categorized into the following three groups.

First, there is a process in which HDS (hydrodesulfurization) and HDA (hydro-dearomatization) are accomplished simultaneously under a high temperature and high pressure with a nickel-molybdenum-based catalyst of high activity in a single reactor. The process is, however, not widely used because high temperature and high pressure facilities, together with a low processing rate, significantly increase the investment cost and still cannot achieve a desirable aromatics conversion rate.

A second process utilizes two reactors placed in series. Deep HDS is achieved in the front reactor while the rear reactor charged with a noble metal catalyst, reduces aromatic compounds. The process is usually constructed by adding a new HDA unit in the rear of the existing HDS unit. HDA conversion rate is significantly improved compared to a stand-alone HDA unit. However, investment cost and operation cost also increase significantly.

Third, there is the Syn-Sat process in which HDS and HDA are conducted at a high efficiency by utilizing countercurrent flow in a single reactor. The Syn-Sat process enables higher conversion rates than any other processes, and the process economics are superior to two-stage reaction processes. Yet, the Syn-Sat process still requires significant amount of investment cost as well as operation cost compared to deep HDS processes. In addition, close attention regarding HDA catalyst poisoning is required so that the HDS exit stream contains no more than 10 ppm (wt) of sulfur compounds.

As noted above, conventional processes treating LGO have technical limitations while breakthroughs in catalyst activity have not been realized. Therefore, methods using different feedstocks instead of LGO, or using innovative reaction pathways, are being studied and practiced in manufacturing cleaner diesel fuel.

Hydrocracking processes, using VGO (Vacuum Gas Oil) instead of LGO, exemplify such methods. Since VGO has very high sulfer content and nitrogen compound content, HDS and hydrocracking reactions are carried out in two-stage reactors at high temperature and high pressure. Kerosene and diesel distillates obtained from hydrocracking are nearly sulfur-free and contain 50% less aromatic compounds compared to that of the products from LGO HDS processes. However, due to the high viscosity of the feed, the reaction efficiency is relatively low and the investment cost is almost three times higher than that of conventional deep HDS processes.

Another process suggested is to polymerize natural gas to produce a diesel distillate such as Shell's middle distillate synthesis (SMDS) process. In the SMDS process, natural gas is converted into syn-gas through the Fischer-Tropsch reaction, then it undergoes polymerization to produce diesel distillates free of sulfur and aromatic compounds. However, since the feed is fairly expensive, and since the reaction is carried out in three steps, a high investment cost is needed. Consequently, it is difficult for most refiners to attain an economical benefit unless they have their own natural gas field and gas-to-liquid conversion process near the natural gas field.

Recently, a new technology using a bio-catalyst, referred to as a biodesulfurization process, is under development. Regarded as supplementary for HDS processes, biodesulfurization selectively removes the refractory sulfur compounds, which are difficult to remove by conventional HDS. However, it is reported that the biodesulfurization process does not yet have the sufficient reaction efficiency (space velocity is about 0.1 $hr^{-1}$) applicable for oil refineries where large-scale treatments are required. Biodesulfurization also generates byproducts such as phenols.

U.S. Pat. No. 5,454,933 discloses an adsorption process to produce sulfur-free diesel fuel by removing sulfur compounds from an HDS-treated LGO stream. Despite using similar adsorption principles, the present invention differs from that patent's disclosed invention in that NPC is removed, instead of sulfur compounds, upstream of an HDS unit to improve sulfur conversion rate of the HDS unit.

Adsorption, in general, is known to be ineffective in removing the sulfur compounds from a petroleum hydrocarbon stream. Sulfur compounds have relatively low polarities compared to nitrogen or oxygen compounds, and an adsorbent which can adsorb as much sulfur compounds as 0.05% of feedstock is difficult to come by. Activated carbon usually tends to gradually lose its adsorption effectiveness as desorption is repeatedly performed. Therefore, to maintain sulfur removal rate, the adsorbent must be regenerated more frequently. This will, however, result in yield loss and increased operation cost with less amount of feedstock treated and more amount of solvent spent in an operation cycle.

Since the disclosed invention of U.S. Pat. No. 5,454,933 does not indicate whether sulfur removal rate is maintained, a series of experiments was performed by using activated carbon, having similar physical properties to that used in U.S. Pat. No. 5,454,933: it was revealed that sulfur removal rate was not satisfactory, the sulfur removal rate decreased as desorption was repeated, and the generation of desorption extract, the byproduct, was excessive. Results of the experiments are tabulated in Comparative Example 18 below.

U.S. Pat. No. 5,730,860 discloses a technique in which the limit in producing gasoline products 30 ppm (wt) or less in sulfur content can be overcome through a conventional hydroprocessing process. According to this technique, hydrocarbons with high concentrations of sulfur, nitrogen and oxygen compounds (for example, mercaptan, amine, nitrile and peroxide, exemplified by fluidized catalytic cracking (FCC) gasoline, a half-finished gasoline product) are treated with a counter current-type fluidizing adsorption process and the adsorbent used is regenerated by use of hot hydrogen, after which the adsorbate concentrated with hetero-compounds is subjected to HDS. But this technique has the limitation that it can't be applied to a hydrocarbon stream having a boiling range of 260° C. or higher. In addition, since the by-products produced in the above process must be treated in the diesel HDS process, the desulfurization performance under deep HDS conditions may be negatively affected. Therefore, applying this technique is problematic to the current situation wherein ultra low sulfur diesel fuel has to be produced concurrently with gasoline.

Besides, bio-diesel products which are prepared by formulating existing oil products with the oils extracted from plants in an amount of about 20%, were found to produce pollutants at a significantly reduced amount. These bio-diesel products, which are developed as an alternative fuel in some countries rich in agricultural products, cause a significant problem, so they are suggested to be formulated at the amount of about 20% with conventional diesel fuels. In this case, however, there is also caused a significant problem in storage stability.

As explained above, various attempts have been made to produce cleaner oils, but they are either economically unfavorable because of large-scale investments or technical limitations.

The intensive and thorough research on the manufacture of cleaner fuels, carried out by the present inventors, resulted in the finding that the pretreatment of LGO with such well known techniques as adsorption or solvent extraction, permits a great improvement over the HDS performance of the catalysts used in a deep HDS zone. Oil fractions removed during the pretreatment step of the present invention are composed of various kinds of compounds having such functional groups as —COOH (naphthenic acids), —OH (phenols), —N (pyridines) and —NH (pyrroles), and sulfur-containing compounds having higher polarity other than that of dibenzothiophene, as exemplified in Example 4, below. Nitrogen-containing compounds are mainly heterocyclic compounds such as carbazoles, benzocarbazoles, Indoles, pyridines, quinolines, acridines, and tetrahydroquinolines. Even though saturated and aromatic compounds are also contained in these fractions, the fractions are characterized by relatively high polarities due to the high concentration of polar organic compounds as described above. Such polar compounds exist in trace amounts, overall, in petroleum hydrocarbon. Therefore, these polar organic compounds are defined herein as NPC (Natural Polar Compounds) so as not to be confused with synthetic polar compounds, such as process additives or chemicals, and the like.

Depending on the crude oil source, viscosity and pretreatment of the distillates, NPC have different physical properties and composition. Being almost electrically neutral, the NPC separated from LGO can be grouped into acidic, basic and neutral compounds.

Although NPC content becomes higher in petroleum products with higher boiling points, NPC exists in relatively small quantities, so that the removal of the compounds has little influence on the physical and chemical properties of the remaining fraction, such as, for example, viscosity range and the content of sulfur and aromatic compounds. Therefore, NPC do not harm catalysts or catalytic processes unlike byproducts or impurities. NPC have not burdened the achievement of the sulfur conversion target of the HDS process even though NPC have relatively high polarities and densities compared to the distillates that NPC derive from.

However, it was found by the present invention that even small quantities of NPC have a significantly negative effect upon the HDS process in the deep desulfurization zone, which can be achieved only if such compounds as dibenzothiophene (DBT) and 4,6-dimethyl dibenzothiophene (4,6-DMDBT) are converted. Consequently, the present inventors conducted extensive research on removal of NPC, and it is found that such well-known technologies as adsorption and solvent extraction can be used as an effective pre-treatment, upstream of an HDS unit, to produce cleaner fuels.

To remove impurities or polar compounds from hydrocarbons, adsorption or solvent extraction has been widely used for a long time. For example, U.S. Pat. No. 5,300,218 discloses the use of an optimal adsorbent such as a carbon molecule complex in removing diesel smoke-causing materials. U.S. Pat. No. 4,912,873 also discloses an adsorption process that treats diesel fuel and jet fuel with a polymer resin to minimize coloration and filter clogging problems. However, the carbon molecule complex or the polymer resin are not effective in achieving a beneficial NPC removal ratio and are too expensive to be used as an adsorbent for the present invention. Moreover, the application ranges of the carbon molecule complex or polymer resin are different from that of the present invention, which is related to the improvement of the catalytic activity of hydroprocessing.

Of petroleum and petrochemical manufacturing processes, catalytic reaction processes take significant portions, and protecting the catalysts from permanent performance loss is an important issue. To prevent permanent performance loss owing to by-products and/or impurities originating from former stages or feedstock, various pretreatment processes are being utilized. Among such pretreatment processes, principles of adsorption or solvent extraction are commonly applied thereto. Typical examples include mechanical filters preventing accumulation of micro impurities; a caustic washing column where naphthenic acids in raw materials are neutralized and extracted to protect basic catalysts in the Merox process; and an activated clay column that adsorbs sulfur and olefins prior to a naphtha reforming process.

Particularly, the isomerization and etherification process are vulnerable to impurities damaging the catalysts, and extensive research has been done on pretreatment techniques for removing such impurities, as representatively disclosed in U.S. Pat. Nos. 5,516,963, 5,336,834, 5,264,187, 5,271,834, 5,120,881, 5,082,987, 4,795,545 and 4,409,421. However, the application ranges of these, the feedstock or processes of these references, are different from that of the present invention.

U.S. Pat. Nos. 4,344,841, 4,343,693 and 4,269,694 pertain to adsorption techniques for preventing water, sediments and additives from causing deposit formation and equipment fouling in catalytic processes, e.g., subsequent hydrotreating processes.

U.S. Pat. No. 4,176,047 discloses an adsorption pretreatment process using waste alumina catalysts in the Delayed Coker process that prevents silicon-based antifoaming agents from having a negative influence on subsequent HDS processes and processes that improve octane number.

U.S. Pat. No. 4,033,861 discloses a method for reducing nitrogen contents in hydrocarbon by polymerizing nitrogen compounds that are difficult to be removed by hydrodenitrification, and separating them with their increased boiling points.

U.S. Pat. No. 3,954,603 discloses a method of removing catalyst-poisoning contaminants, such as arsenic or selenium, from a hydrocarbon stock, such as Shale oil, Syncrude and bitumen, in a two-step pretreatment process using iron, cobalt, nickel, oxides or sulfides of these metals, or mixtures thereof.

Scrutinizing the prior art, as explained above, adsorption and/or solvent extraction are used only for product quality improvements and for cases where a catalytic reaction process cannot be physically operable due to additives, impurities or byproducts originating from a former stage and/or from feedstock. Thus far, there has been no pretreatment that is developed upon the basis of the fact that the NPC removal, the kernel of the invention, has a great influence on the catalyst activities in the deep HDS zone.

SUMMARY OF THE INVENTION

The present invention aims to achieve an improvement in catalytic processes by removing NPC that naturally exist in crude oil. The constituents of NPC do not cause a fatal influence on the activity of catalysts used in general processes, and are normally converted according to their own reaction pathways in catalytic processes. However, where certain sulfur compounds, which require high activation energies for their removal, need to be desulfurized in order to approach a desulfurization rate of 97% or higher, NPC is found to have a significant influence on the reaction pathways and reaction effectiveness of the sulfur compounds.

According to the present invention, the influencing factors, in the form of NPC, can be easily removed through adsorption/desorption or solvent extraction techniques, and the NPC-removed feedstock enhances HDS rate by 1–2%. This fraction of improvement may seem to be marginal. However, this additional 1–2% is significant in the deep HDS zone, making it possible to produce diesel fuel with a sulfur content of 50 ppm (wt) or less in a more economical way than any other processes known to date.

Although various technologies for the desulfurization and dearomatization of diesel distillates have been developed, oil companies do not regard them as economically feasible.

With the aim of economically producing petroleum products containing less sulfur, nitrogen and aromatic compounds for reducing harmful tailpipe emission from diesel vehicles, the present invention includes the removal of NPC, which was nowhere mentioned in the prior art, improves the efficiency of existing catalysts, and has advantages over prior art processes which require excessive investments and operation costs. As a consequence of the intensive and thorough experiments that the present inventors repeated, in an effort to apply the principle of the invention to commercialization, it was revealed that some adsorbents can be continually regenerated in such adsorption/desorption applications, and such NPC removal improves the performance of subsequent catalytic reaction processes for various feedstocks.

In addition, regarding the lubricity degradation resulting from deep desulfurization, it has been found that concentrated NPC, obtained by adsorption, is effective as a natural lubricity improver.

Although fixed bed adsorption technology was adopted to prove the invention in most cases, the application to other types of pretreatment, which can be selected depending upon feedstocks, including fluidizing bed adsorption and solvent extraction, is also included in the scope of the invention.

DETAILED DESCRIPTION OF PREFERRED EMBODIMENTS

Figure 1:
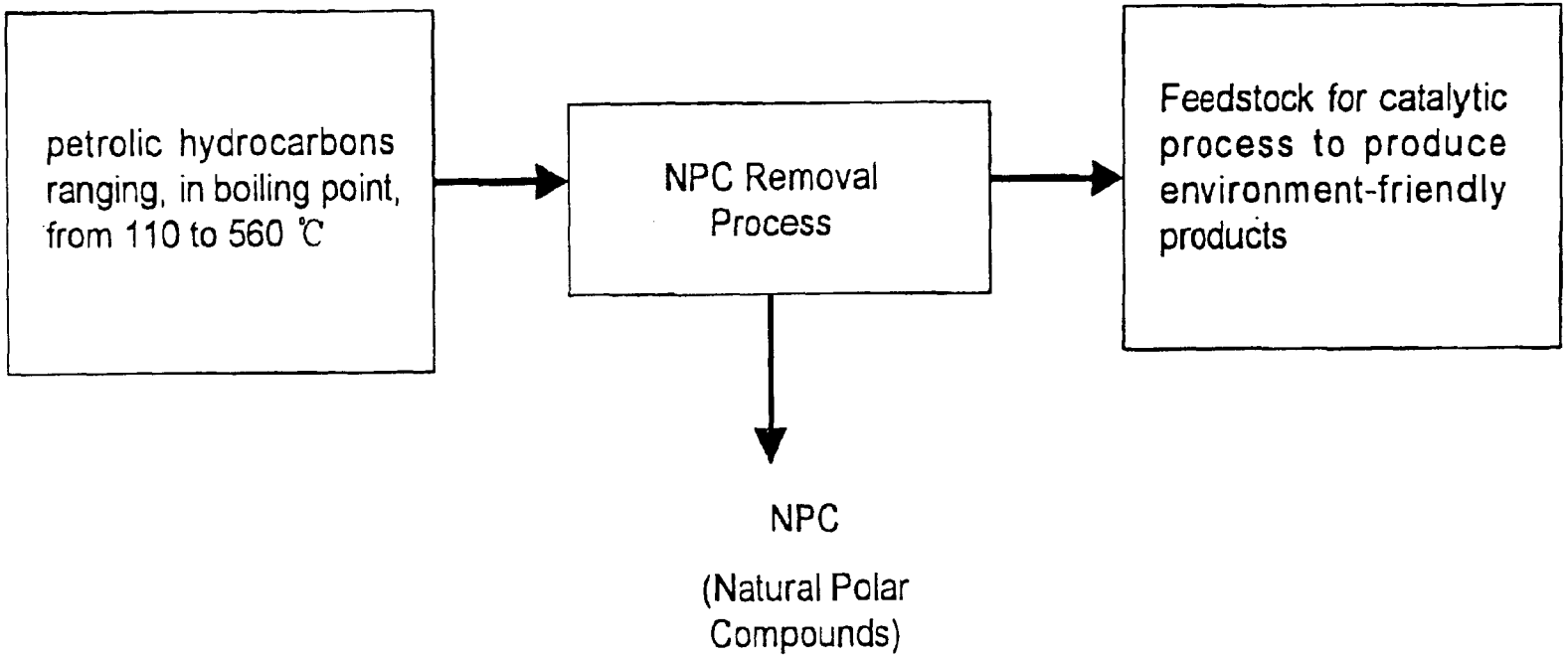
FIG. 1 is a flow diagram illustrating a basic concept of the present invention.

The present invention pertains to the substantial removal of NPC from petroleum hydrocarbon fuel stocks, which improves activity of catalysts in subsequent hydroprocessing processes, thus facilitating economical production of cleaner fuels that emit lower levels of pollutants, especially PM, $NO_x$, and $SO_x$, upon combustion in engines. The overall concept of the present invention is illustrated in FIG. 1. The petroleum hydrocarbon fuel stocks used in the present invention range in boiling point, from 110 to 560° C. and preferably from 200 to 400° C. NPC, naturally existing in these petroleum hydrocarbon fractions, can be removed by adsorption or solvent extraction. Removal of NPC through adsorption utilizing one or more adsorbents is found to be the most effective method according to a series of experimental studies carried out for this invention.

Hydrocarbon fuel produced in accordance with the present invention preferably has a boiling point in the range of 110° C. to 400° C. and preferably has a sulfur content less than 500 ppm (wt), and most preferably less than 50 ppm (wt).

Adsorption is, therefore, extensively used in the following examples, and experiments are carried out with a single column to simplify the illustration of the present invention. The actual process can perform adsorption and desorption in a continuous manner by alternately switching two or more fixed beds.

In accordance with the invention, NPC are removed from a petroleum feedstock fraction to substantially decrease the concentration of NPC in the petroleum feedstock fraction. The substantial decrease in NPC concentration is at least 50%. That is, at least 50% of NPC are removed from the petroleum feedstock fraction. Preferably, between about 60% and about 90% of the NPC are removed from the petroleum feedstock fraction.

As shown in the examples below, NPC are removed easily from hydrocarbon feedstock by alternating adsorption and desorption in a single adsorption column. The NPC removed or extracted from a petroleum feedstock fraction preferably comprise between 5.0 and 50 wt % oxygen-containing compounds, between 5.0 and 50 wt % nitrogen-containing heterocyclic compounds and sulfur content in the range of 0.1 to 5.0 wt %. The NPC removed or extracted preferably constitutes between 0.1 and 5.0 wt % of the petroleum feedstock fraction.

Generally, as the boiling point of the feedstock increases, the viscosity increases and the amount of NPC extracted (and the nitrogen content in the NPC) tends to become larger. So, depending on the feedstock, the operation parameters of the adsorption pretreatment process such as RPA (Ratio of Product to Adsorbent), temperature and LHSV (liquid hourly space velocity, $h^{-1}$) may vary. Among these parameters, RPA is the most important operation parameter of the pretreatment process. RPA is further defined as a ratio of the amount of the treated product to that of the adsorbent within one operating cycle, which consists of adsorption, co-purging and regeneration steps in series. As RPA is lowered, the severity of the adsorption process and the adsorption performance increases.

Examples of available adsorbents include active alumina, acid white clay, Fuller's earth, active carbon, zeolite, hydrated alumina, silica gel, and ion exchange resins. Hydrated alumina and silica gel have no strong adsorption sites and such adsorption mechanism as hydrogen bonding is uniquely desirable for regenerability. The aforementioned adsorbents may be used in combinations of two or more, and a proper combination may enhance adsorption effectiveness; silica gel and ion exchange resin, which are charged in an adsorption column in series, are found to be more effective in NPC removal than using silica gel or ion exchange resin alone.

A preferred adsorbent is silica gel, having a pore size ranging from 40 to 200 Å, a specific surface area ranging from 100 to 1000 $m^2/g$, and a pore volume ranging from 0.5 to 1.5 cc/g.

Figure 2:
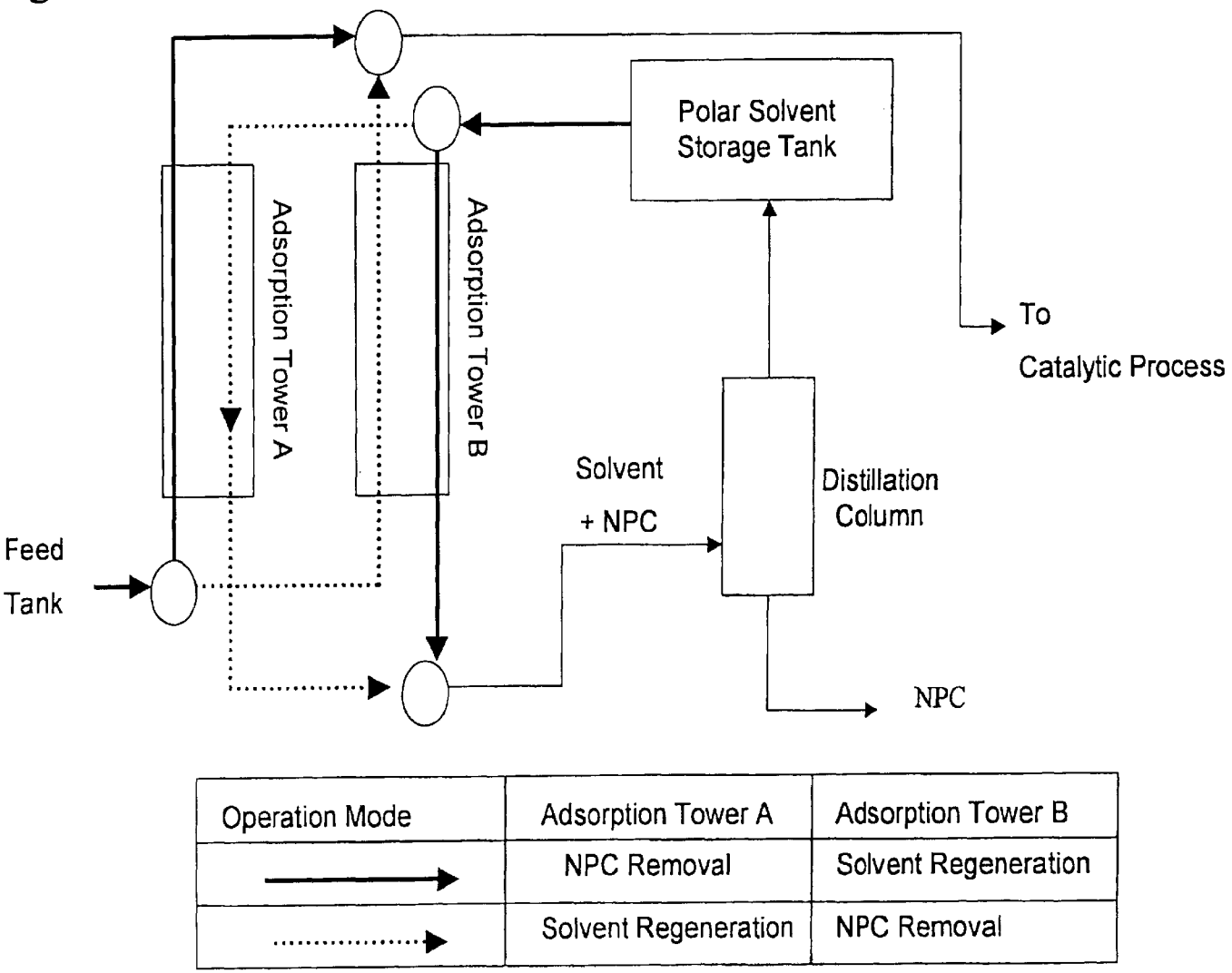
FIG. 2 is a simplified flow scheme of an adsorption process according to the present invention.
Figure 3:
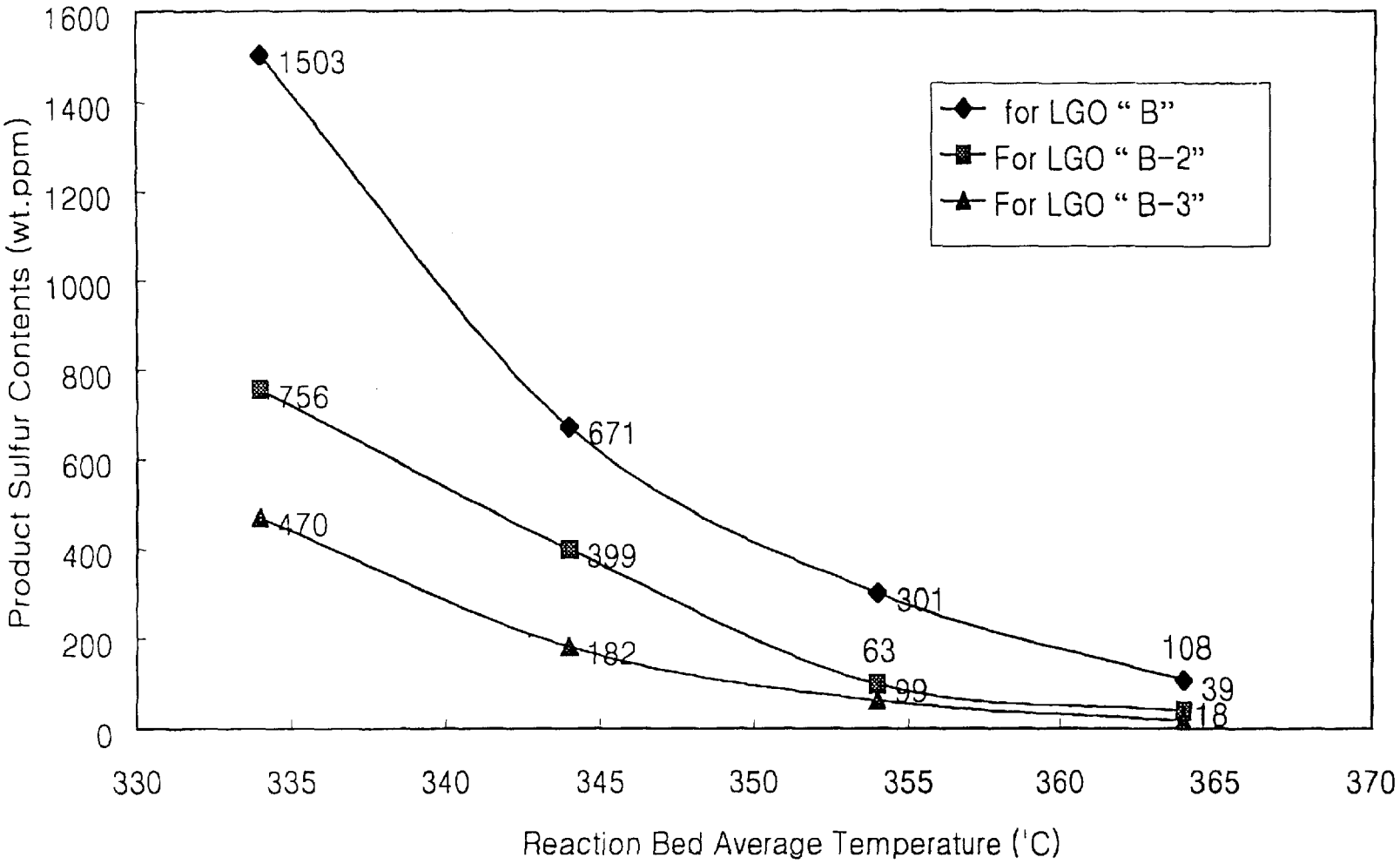
FIG. 3 is a graph of product sulfur concentration versus reaction temperature for two kinds of NPC-removed feedstocks, and a base feedstock, in accordance with Example 13.

With reference to FIG. 2, there is shown an operation scheme of an adsorption process according to the present invention. First, liquid hydrocarbon stream is fed for a predetermined period of time into one of two or more adsorption columns, alternately, wherein NPC is adsorbed.

While the NPC-removed hydrocarbon liquid is fed to a subsequent catalytic process, the NPC adsorbed in the adsorption columns are desorbed by the use of a desorption solvent so as to regenerate the adsorption column. The desorption solvent is usually selected from among alcohols, ethers and ketones containing 6 or less carbon atoms, which are exemplified by methanol, methyl-tertiary-butyl ether and acetone. Generally, the aforementioned solvents have low boiling points, so that they are easily distilled and recovered from feedstock or NPC. Instead of the aforementioned scheme where the two fixed beds are utilized, either a fluidizing bed or a moving bed may be applied to deliver the same results.

The catalytic reaction processes, which follow the adsorption pretreatment step, can be an HDS, an HDA, a mild hydrocracking, a hydrocracking process, or combinations thereof. The catalysts used in these processes have acidic active sites on the catalyst surfaces and hetero-atom containing polar compounds decrease the catalysts' activities due to the tendency of these compounds to be adsorbed onto the active sites, while they do not deactivate the catalysts permanently.

Also, the present invention pertains to the use of NPC as a natural lubricity improver against the lubricity degradation resulting from the deep desulfurization.

In such an application, the NPC is concentrated such that the content of nitrogen in the NPC becomes substantially higher than the feedstock by a factor of 10 or higher (preferably 50 times greater) and the content of oxygen-containing organic acids or phenols is in the range of 10 wt % or greater and preferably 15% or higher. NPC is preferably concentrated by adsorption processes, preferably utilizing adsorbents selected from the group consisting of activated alumina, acid white clay, Fuller's earth, activated carbon, zeolite, hydrated alumina, silica gel, ion exchange resin, and combinations thereof.

As more NPC is extracted by adsorption, nitrogen content, sulfur content and total acid number decrease. Nitrogen content, in particular, turns out to be closely related with NPC removal ratio, as illustrated in Example 4. While it is also expected that the content of oxygen-containing compounds should vary with NPC removal, tracking down the changes in oxygen content of treated hydrocarbons is extremely difficult since the change occurs within the error margin of oxygen content analysis. The NPC removal ratio could be exactly quantified if changes in NPC weight are measured and compared. However, the measurement takes an impractically long time. Consequently, NPC removal ratio is represented by changes in nitrogen content in the following examples, since nitrogen content is easy to analyze with reasonably small error margins as shown in Example 4.

EXAMPLE 1

LGO and light cycle oil (LCO), used as a feedstock in the present invention, vary in their properties according to the crude oil type. In Table 1, the properties and the compositions of various LGOs and an LCO are given. These oils are exclusively used in connection with he present invention. As mentioned previously, the composition and properties of NPC may vary with the feedstock used, but such variation does not limit the present invention. In Table 1, "A", "B" and "C" are LGOs with different boiling points, sulfur contents and nitrogen contents, while "D" is an LCO produced from an atmospheric residue (AR) fluid catalytic conversion (FCC) process.

TABLE 1

| Feed Characteristics | A | B | C | D |
|---|---|---|---|---|
| Sulfur, ppm (wt) | 12,286 | 15,420 | 14,056 | 8,738 |
| Nitrogen, ppm (wt) | 226 | 173 | 156 | 2,503 |
| Distillation, ° C. | | | | |
| IBP | 228 | 220 | 227 | 285 |
| 10% | 270 | 261 | 274 | 323 |
| 50% | 311 | 308 | 306 | 343 |
| 90% | 367 | 375 | 353 | 355 |
| EP | 388 | 382 | 368 | n/a |

IBP = initial boiling point
EP = end point (final boiling point)

EXAMPLE 2

Silica gel, alumina and ion exchange resins, which are commonly used in column chromatography, were selected as adsorbents in the present invention. Physical properties of the adsorbents used are given in Table 2.

TABLE 2

| I.D. | Adsorbent | Pore Vol. cc/g | Avg. Pore Size,Å | BET Surface Area $m^2/g$ |
|---|---|---|---|---|
| a | Silica gel | 0.38 | 20.19 | 733.2 |
| b | | 0.45 | 25.9 | 700.27 |
| c | | 0.74 | 48.55 | 607.95 |
| d | | 1.05 | 68.98 | 608.05 |
| e | | 1.07 | 104.39 | 410.94 |
| f | | 1.16 | 164.34 | 283.47 |
| g | | 1.16 | 234.4 | 198.24 |
| h | Alumina | 0.79 | 50~70 | 100~200 |
| i | Ion Exchange Resin | 0.55 | 450~500 | >400 |

EXAMPLE 3

To compare the NPC removal effectiveness of different adsorbents, a series of experiments were conducted using the silica gels in Table 1, identified as "a" through "g", having diameters ranging from 0.3 to 0.5 mm. The adsorption /desorption procedure was as follows:

1) 40 cc of the adsorbent "a" was loaded in the inner tube of a concentric glass column.

2) The temperature of the adsorbent bed was maintained constant by circulating water through the outer jacket of the concentric column at 50° C.

3) 400 cc of the LGO "A" was fed at a flow rate of 200 cc/hr into the inner tube where adsorbent was charged.

4) Upon completion of step 3), 80 cc of a non-polar solvent, hexane, was pumped into the inner tube at 200 cc/hr.

5) The inner tube was purged with nitrogen.

6) The products obtained from steps 3), 4), and 5) were mixed together.

7) The products of step 6) were separated from the solvent by a rotary evaporator, keeping the remnant as "NPC-removed LGO".

8) Upon completion of step 5), 80 cc of a highly polar solvent, methyl-tertiary-butyl-ether, was introduced at 200 cc/hr to the inner tube.

9) The inner tube was purged again with nitrogen.

10) Product obtained from steps 8) and 9) was mixed together.

11) The product of step 10) was separated from the solvent by the use of rotary evaporator, keeping the remnant as "NPC".

12) The procedure from steps 3) to 11) was repeated two more times.

13) For the adsorbents "b" through "g", the procedure of steps 1) to 12) was repeated, respectively.

TABLE 3

| | Nitrogen Removal Ratio (%) | | |
|---|---|---|---|
| Adsorbents | 1st | 2nd | 3rd |
| a | 6 | 5 | 7 |
| b | 22 | 21 | 21 |
| c | 53 | 52 | 52 |
| d | 62 | 61 | 60 |
| e | 51 | 54 | 53 |
| f | 46 | 47 | 47 |
| g | 49 | 50 | 50 |

Nitrogen removal ratio is determined as [(feed N−product N)×100]/(feed N content), wherein product N is the nitrogen content of adsorption-treated hydrocarbon.

The comparison between the performances and physical properties of adsorbents showed that their adsorption performance was closely related with their pore volume, pore size and specific surface area: the larger the pore volume was, the better the adsorption performance was. As the pore volume increased, the pore size increased while the specific surface area decreased From the results, the adsorbent, silica gel, with pore volume from 0.5 to 1.5 cc/g, pore size from 40 to 200 Å and specific surface area from 10 to 1,000 $m^2/g$ is desirable for treating LGO. For example, if the pore volume is less than 0.5 cc/g or if the pore size is less than 40 Å, adsorption would not be effective. On the other hand, if an adsorbent has too large a pore volume, physical strength of the adsorbent is significantly weakened and the surface area is drastically reduced.

EXAMPLE 4

The NPC obtained in Example 3 were analyzed for chemical species as follows:

1) 103.47 g (200 ml) of silica gel (Merck Silica gel 60, 70–230 mesh ASTM) were charged in a glass column (1 m×2.5 cm) for medium pressure chromatography.

2) 10.00 g of the NPC obtained in Example 3 were dissolved in n-pentane and this solution was poured onto the glass column, followed by flowing 500 ml of n-pentane, 500 ml of a mixed solvent of 1:1 n-pentane:toluene, 500 ml of toluene and 500 ml of methanol, in sequence, through the column.

3) Six effluent fractions F1 to F6 were obtained such that the aliquot amount was 250 ml each for the first four fractions (F1–F4), 500 ml for the fraction F5 and 300 ml for the last effluent, F6.

4) Each fraction was introduced to a rotary evaporator for solvent removal and the residue was weighed.

5) Qualitative analyses were conducted using an Antek Analyzer for nitrogen and sulfur content, a FT-IR analyzer, and a GC-MSD and a GC-AED for N and S species.

6) Using a field desorption (FD)-mass spectrometer, a semi-quantitative analysis was done for certain chemical species in each of the fractions through molecular weight comparison. A series of mass peaks were selected at a mass interval of 14 if coincided within the allowed limit of mass difference of 0.05 with comparison to the calculated molecular weight, which are regarded as a chemical group with alkyl substitutes. In order to confirm the accuracy of the mass measurement, a mass correcting standard (polyethylene glycol: PEG) was analyzed after the mass measurement of the samples. The PEG mass measured was consistent with the calculated mass within an error range of 0.03.

The results are given below in Table 4.

TABLE 4

| | F1 | F2 | F3 | F4 | F5 | F6 |
|---|---|---|---|---|---|---|
| Yield % | 18.0 | 2.8 | 11.8 | 5.0 | 19.5 | 42.9 |
| S,ppm(wt) | 1746 | 44496 | 42514 | 31077 | 16365 | 17569 |
| N,ppm(wt) | 0 | 0 | 1688 | 30450 | 20434 | 27798 |
| FT-IR | Typical n-alkane spectra | — | Aromatic | Pyrrole NH Aromatic | Pyrrole NH Aromatic COOH | COOH |
| GC-AED-MSD | Non-DBTs | DBTs | DBTs CBZs: n.d. | DBTs: n.d. CBZs | DBTs: n.d. CBZs Amines pyridine | DBTs: n.d CBZs: n.d |
| FD-Mass | Acids, Phenols: 29%<br>Pyridines, Quinolines, Carbazoles, Benzocarbazoles, Indole, Acridines: 32%<br>Paraffins: 5%<br>Naphthenes: 4%<br>Aromatics, Sulfur-containing compounds & unknowns: 30% | | | | | |

* DBTs Dibenzothiophenes; CBZs Carbazoles; n.d not detected

As is apparent from Table 4, NPC was found to be a polar mixture of polar compounds, in which such nitrogen-containing compounds as pyridines, quinolines, acridines, carbazoles, benzocarbazoles, indoles, and such oxygen-containing compounds as organic acids, and phenols, comprise over half of the total weight. In fact, the change in the properties and compositions of LGO before and after the adsorption resulted mainly from changes in its nitrogen and oxygen contents.

The data of Table 4 also demonstrate that most of the sulfur compounds in NPC have a longer retention time than that of DBTs. Also, the sulfur compounds are concentrated twice as much as DBTs in terms of the number of molecules. It is generally known that polycyclic sulfur compounds, e.g. having 3 or more aromatic rings, have stronger adsorptivity than DBTs in the gas oil. Hence, it can be deduced that polycyclic sulfur compounds are concentrated in NPC. However, the change in sulfur content before and after the adsorption was only a trace amount. The reason is that the content of the polycyclic sulfur compounds in unit volume of feedstocks was extremely low. From these analytical data, it can be deduced that oxygen, nitrogen and polycyclic sulfur-containing compounds, which tend to be adsorbed on the active sites of the catalysts in desulfurization or denitrification reactions, were separated and accumulated in the NPC during the adsorption pretreatment, resulting in a significant increase in reaction rate compared to the case in which NPC remained in the reactant and played the role as "activity inhibitor", especially in the deep hydrodesulfurization.

To further examine the correlation between physical properties of NPC-removed LGO and the NPC removal ratio, the following experiments were conducted in a similar manner to Example 3, but adsorbent "c" was used to adsorb feedstock "B". Physical properties of NPC-removed LGOs were analyzed and compared, varying with the RPA.

TABLE 5

| RPA | 10 | 20 | 40 | 80 | $R^2$ |
|---|---|---|---|---|---|
| NPC over Feed LGO (g/Liter) | 4.86 | 3.11 | 1.99 | 1.11 | |
| Nitrogen Removal Ratio, % | 55 | 39 | 29 | 13 | 0.973 |
| TAN reduction rate, | 94 | 74 | 66 | 26 | 0.849 |
| Sulfur Removal Rate, % | 3.7 | 2.3 | 0.7 | 1.7 | 0.721 |

EXAMPLE 5

The same procedure as in Example 3 was repeated, except that the feedstock B was used, along with 40 cc of an adsorbent selected from the adsorbents "d", "h" and "i" and the combinations thereof. 200 cc of "feedstock B" was introduced at a rate of 200 cc/hr through the bed charged with the adsorbents ranging, in diameter, from 0.3 to 0.5 mm. The procedure was repeated 12 times to test the adsorbents for regenerability. Table 6 shows the nitrogen removal ratio of the adsorbents from the feedstock B deprived of NPC.

TABLE 6

| Adsorbents | Nitrogen Removal Ratio (%) | | | |
|---|---|---|---|---|
| Charged | 3rd | 6th | 9th | 12th |
| d | 72 | 73 | 74 | 73 |
| i | 48 | n/a | n/a | n/a |
| d:h = 1:1 | 92 | 90 | 85 | 80 |
| d:i = 1:1 | 76 | 73 | 74 | n/a |
| d:i = 1:2 | 77 | 77 | 77 | n/a |

In the above Examples 2, 3 and 4, it was revealed that the NPC removal could be achieved by various adsorbents, such as ion exchange resins; the nitrogen removal ratio, however, may vary with different adsorbents. In addition, it was also found that combinations of two or more adsorbents could enhance the nitrogen removal ratio. For example, in the case of d:i in Table 6, where an adsorption column was prepared with ion exchange resin "i", which was charged immediately after the silica gel "d", then the nitrogen removal ratio improved as much as 3–5% points compared to the case "d"; where silica gel is used alone.

EXAMPLE 6

The same procedure as in Example 3 was repeated, except that the feedstocks "A", "B", "C" and "D" were used, along with 40 cc of the adsorbent "d" having a particle diameter of 0.3 to 0.5 mm. Effluent stream fractions from the feedstocks "A", "B", "C" and "D" were designated A-1, B-1, C-1 and D-1, respectively. The nitrogen removal ratio of the fractions A-1, B-1, C-1 and D-1 are given in Table 7.

TABLE 7

| | A-1 | B-1 | C-1 | D-1 |
|---|---|---|---|---|
| Nitrogen Removal Ratio (%) | 60 | 61 | 61 | 13 |

As is apparent from Table 7, no differences in the nitrogen removal ratios were found among various LGOs, while an extremely low nitrogen removal ratio was given to the LCO, which contained almost ten times higher nitrogen compounds content and was also high in viscosity and aromatics content. Therefore, adsorption turned out to be an effective pretreatment technology for LGO that has a relatively low level of nitrogen contents, viscosity and aromatics, but may not be a good one for LCO.

EXAMPLE 7

The same procedure as in Example 3 was repeated, except that the feedstock A of 2,000, 3,000 and 4,000 cc was introduced at a rate of 1,000, 2,000 and 4,000 cc/hr through a bed charged with 400 cc of the adsorbent d ranging, in diameter size, from 0.85 to 1.0 mm. Together with pressure drop across the adsorption bed and the amounts of the polar solvent used, the nitrogen removal ratio for LGO is given in Table 8, below. Also, there is shown the pressure drop variation with space velocity.

TABLE 8

| Flow Rate (cc/hr) | Treated LGO (cc) | RPA | Nitrogen Removal Ratio (%) | Solvent to LGO Vol. Ratio | Pressure Difference ($kg/cm^2$) |
|---|---|---|---|---|---|
| 1,000 | 2,000 | 5.0 | 74 | 0.40 | 0.75 |
| | 3,000 | 7.5 | 64 | 0.27 | |
| | 4,000 | 10.0 | 58 | 0.20 | |
| 2,000 | 2,000 | 5.0 | 66 | 0.40 | 0.95 |
| | 3,000 | 7.5 | 62 | 0.27 | |
| | 4,000 | 10.0 | 52 | 0.20 | |
| 4,000 | 2,000 | 5.0 | 59 | 0.40 | 1.50 |
| | 3,000 | 7.5 | 50 | 0.27 | |
| | 4,000 | 10.0 | 46 | 0.20 | |

As the space velocity increases at the same RPA, the pressure drop increased while the nitrogen removal ratio decreased. On the other hand, as the RPA decreases at the same space velocity, the nitrogen removal ratio increases. The same tendency, which constitutes a basic operational rule in the removal of NPC by adsorption, is expected for other adsorbent types or adsorption techniques as well.

The particle diameter size of an adsorbent is closely related to the pressure drop: the pressure drop is inversely proportional to the square of the particle diameter. Increasing the particle size may reduce the pressure drop, but also reduces the adsorption performance of the adsorbent. As the particle size increased, the nitrogen removal ratios were shown to be more sensitive to the space velocities. In addition, the NPC removal tends to change with the adsorption temperatures, and the optimal bed temperature is found to be in the range between 40 and 80° C. for LGO. Such a temperature range happens to be very close to the storage temperature of the LGO.

EXAMPLE 8

The same procedure as in Example 3 was repeated, except that only one polar solvent was used along with 40 cc of the adsorbent "d" ranging, in particle diameter from 0.3 to 0.5 mm. The nitrogen removal ratio for the feedstock A is given in Table 9, below.

An experiment was conducted as follows:

1) 40 cc of the adsorbent d was loaded in the inner tube of the concentric glass column.

2) The temperature of the adsorbent bed was maintained constantly by circulating water through the outer jacket of the concentric tube at 50° C.

3) 400 cc of the LGO "A" was fed at a flow rate of 200 cc/hr into the inner tube where the adsorbent was charged.

4) Upon completion of step 3), 40 cc of MTBE vapor was introduced at a rate of 200 cc/hr through the adsorption bed. To vaporize the solvent, a preheating tube was installed and heated to 90° C. and the temperature of the adsorbent bed was maintained constant by circulating water through the outer jacket of the concentric tube at 80° C.

5) The product obtained from steps 3) and 4) was mixed together and the solvent was removed by the use of a rotary evaporator, keeping the remnant as "NPC-removed LGO".

6) Upon completion of step 5), 80 cc of liquid MTBE was injected at 200 cc/hr to the inner tube.

7) The product of step 6) was separated from the solvent by the use of a rotary evaporator, keeping the remnant as "NPC".

TABLE 9

| | |
|---|---|
| Nitrogen Removal Ratio (%) | 62 |

In contrast to Example 4, in which two different solvents were used, Example 8 employed only one polar solvent, but resulted in a similar nitrogen removal ratio. This result bears in determining what regeneration techniques should be used for the adsorbents. For instance, ebullated bed or fluidized bed, which cannot be operated with two different solvents, could be applicable for the adsorption pretreatment step.

EXAMPLE 9

In addition to adsorption, a series of solvent extraction experiments were conducted using a polar solvent to verify whether solvent extraction removed NPC, and whether solvent extraction brought the same degree of improvement as adsorption did to the HDS process. The following procedure was used.

1) 500 cc of the feedstock "B" was mixed and stirred along with an equal volume of methanol in a mixer.

2) After completing the mixing and stirring, the mixture was allowed to settle for 5 min to give phase separation, followed by draining LGO, which underwent solvent extraction, from the bottom of the mixer.

3) The extracted LGO was treated with a rotary evaporator to remove residual methanol, thereby yielding pure LGO deprived of NPC. The nitrogen removal ratios varying the volume ratios of feedstock "B" to methanol are given in Table 10, below.

4) The same procedure as in steps 1) through 3) was repeated, except that the feedstock was "D" instead of "B". The nitrogen removal ratios, varying with the volume ratio of feedstock "D" to methanol, are given in Table 10, below.

5) In order to prepare the feedstock for the deep desulfurization reaction tests, steps 1) to 3) were repeated to obtain 14 liters of the LGO deprived of NPC, which was designated as "B-SX".

6) Step 5) was repeated, except that the feedstock was "D" instead of "B", to obtain 14 liters of LGO deprived of NPC, which was designated as "D-SX".

TABLE 10

| Feedstock:MeOH | B-SX, nitrogen removal ratio (%) | D-SX, nitrogen removal ratio (%) |
|---|---|---|
| 250 cc:750 cc | 72 | 65 |
| 333 cc:667 cc | 65 | — |
| 500 cc:500 cc | 55 | 23 |
| 667 cc:333 cc | 40 | — |
| 750 cc:250 cc | 31 | — |

7) In order to determine the nitrogen removal capacity of methanol, steps 1) to 3) were repeated to prepare the NPC-deprived LGO and designated "B-SX1".

8) A fresh feedstock "B" was fed again into the mixer, mixed, and stirred for 20 min, together with remaining methanol of step 2). From this mixture, an LGO fraction was extracted and designated as "B-SX2".

9) "B-SX3" was prepared by repeating step 8) in the same manner.

The nitrogen removal ratios for another fresh feed and with the same methanol solvent are given in Table 11, below.

TABLE 11

| Feedstock | B-SX1 | B-SX2 | B-SX3 |
|---|---|---|---|
| Nitrogen Removal Ratio(%) | 55 | 32 | 22 |

The nitrogen removal ratio for feedstock "D" was very low as shown in Table 7 of Example 6. However, by using the solvent extraction method, the nitrogen removal ratio of the feedstocks such as fluidized catalytic cracking (FCC) cycle oil, coker gas oil, or vacuum gas oil, which tend to make it rather difficult to remove NPC through adsorption, can be improved to almost the same level as that of LGO obtained by adsorption, as shown in the data of Table 10. Solvent extraction permits removal of NPC from petroleum feedstock contains heavy gas oils having a final boiling point over 400° C., FCC cycle oil, and coker gas oil.

As illustrated in Tables 10 and 11, as the ratio of the amount of oil to that of solvent for extraction increased, or as the number of solvent recycle increased, the nitrogen removal ratio gradually decreased, which means that the solubility of NPC in the solvent phase approached the saturation point. With the proper selection of a solvent that promotes high NPC solubility, solvent extraction might be a good scheme for removing NPC from heavier distillates.

EXAMPLE 10

The silica gel "d" (Example 2) was tested for its regenerability using the feedstock "B". The LGO that was passed through the adsorption bed was designated as B1. After 40 cc of chromatographic silica gel was charged in the inner tube of the concentric column through which water of 50° C. was circulated, 200 cc of the LGO "B" was passed through the bed. Immediately after this, 80 cc of MTBE was passed through. Fractions of "B1+MTBE" and "NPC+MTBE" were collected after repeating the above procedure 10 times and then MTBE was removed from the fractions by the use of a rotary evaporator. By measuring the nitrogen content of "B" and "B1", the nitrogen removal ratio was calculated. The results are shown in FIG. 4.

Figure 4:
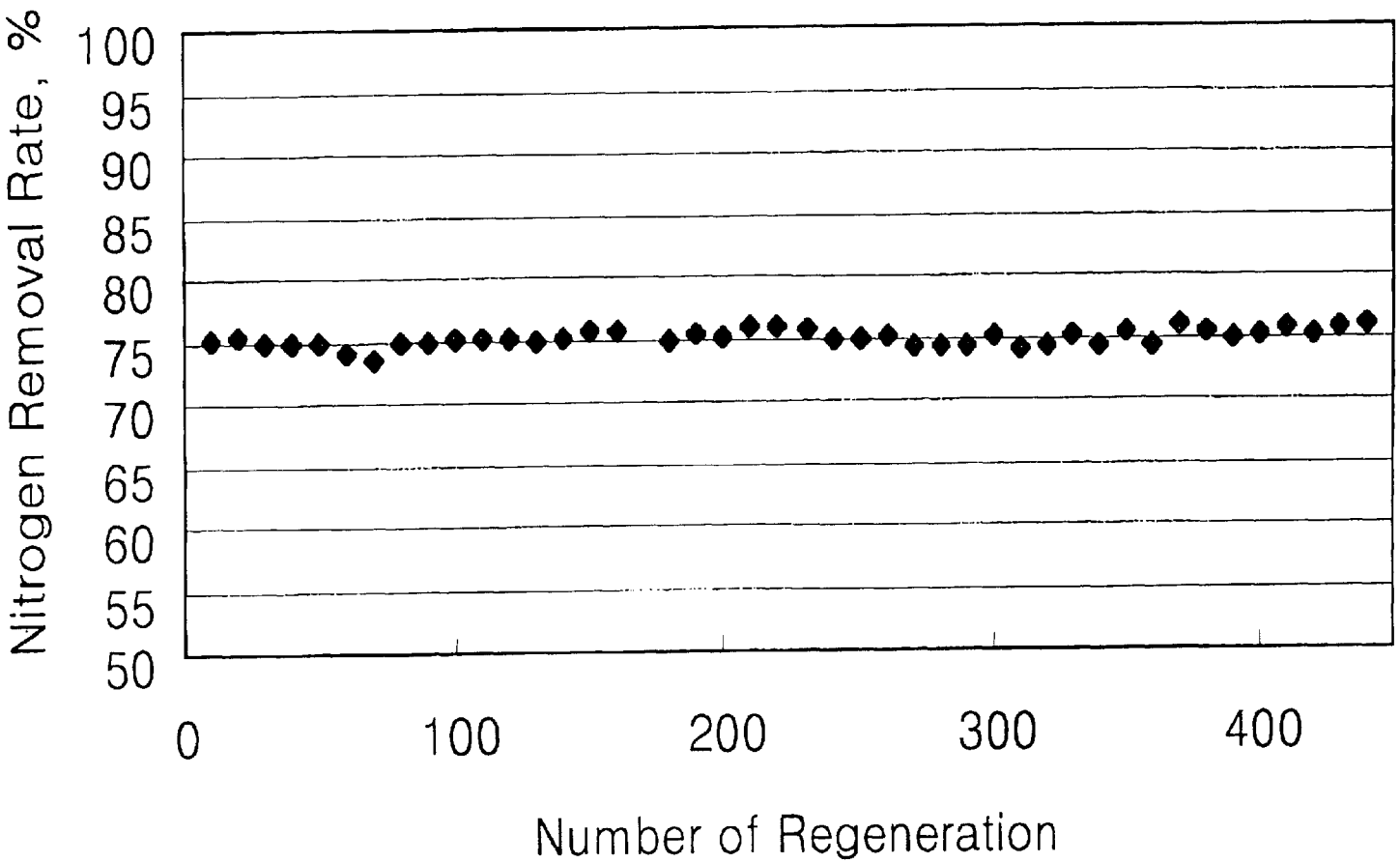
FIG. 4 is a graph of the nitrogen removal rate versus the number of regeneration, in accordance with Example 10.

After having undergone 400 operating cycles, the adsorbent did not produce a degraded nitrogen removal ratio at all, as shown in FIG. 4. Such regenerability is very important for industrial application and the economics thereof.

In general, the adsorption mechanism of silica gel is known to be through hydrogen bonding. Silica gel does not have strong adsorptive sites, unlike activated alumina which has many strong acid sites. Such characteristics explain why silica gel shows superior regenerability. Adsorption to strong acidic or basic sites makes the reverse action (desorption) difficult. It can be recognized from the data of Table 6 in Example 5, where the adsorbent combination d:h=1:1 shows high nitrogen removal ratio in the early stage, but the nitrogen removal ratio falls sharply as the number of regeneration iterations increases.

The regeneration of such adsorbents is possible by heating or by the use of a highly polar solvent, which is also included in the scope of this invention, but is considered to have somewhat limited application. Desirable adsorbents, therefore, must have such regenerative adsorption characteristics as hydrogen bonding, as exemplified by silica gel and hydrated alumina. The performance of the adsorbent also depends on the structural characteristics of the adsorbent and the feedstock properties, such as boiling range, NPC content and the feedstock's composition.

EXAMPLE 11

In order to examine whether and how the NPC-removed LGOs affect the catalyst performance in the HDS process, the feeds for HDS reaction unit were prepared as below.

1) 400 cc of the adsorbent d with a particle diameter from 0.88 to 1.0 mm was loaded at the concentric glass column.

2) The temperature of the adsorbent bed was maintained to 50° C. by circulating water through the outer jacket.

3) 4,000 cc of feedstock "A" was fed at a flow rate of 2,000 cc/hr into the adsorbent bed.

4) Upon completion of step 3), 800 cc of hexane was pumped into the adsorbent bed at a flow rate of 2,000 cc/hr for co-purging.

5) The adsorption bed was purged with nitrogen.

6) Products obtained from steps 3), 4) and 5) were mixed together.

7) The solvent was removed from the products of step 6) by a rotary evaporator, keeping the remnant as "A-2".

8) Upon completion of step 5), 800 cc of methyl-tertiary-butyl-ether was introduced to the adsorbent bed at a flow rate of 2,000 cc/hr.

9) The inner tube was purged again with nitrogen.

10) The procedure from steps 3) to 9) was repeated until the remnant of step 7) amounted to 14 liters.

11) For the feedstock B and C, the procedure from steps 3) to 10) was repeated and the remnants of step 7) were designated as "BB-2" and "C-2" respectively.

12) For the feedstock B, the procedure from steps 3) to 10) was repeated, except that 2,000 cc of feedstock "B" was fed in step 3) and the remnant of step 7) was designated as "B-3".

13) For comparison, 3 liters of an NPC-removed LGO fraction "D-SX" was prepared in a manner similar to that of Example 9, except that NPC was removed by solvent extraction using the feedstock D at methanol ratio of 1:3.

The resulting nitrogen removal ratios are given in Table 12, below.

TABLE 12

| | A-2 | C-2 | B-2 | B-3 | D-SX |
|---|---|---|---|---|---|
| Nitrogen Removal Ratio (%) | 55 | 60 | 60 | 72 | 64 |

EXAMPLE 12

For the purpose of examining the improvement of the catalyst performance as in Example 11, deep desulfurization tests were carried out using the feed A of Example 1 and the feed "A-2" of Example 11. Tested in this example was a catalyst currently being used in a commercial HDS process practiced by the present applicant. Its physical properties are given, together with its chemical composition, in Table 13, below.

TABLE 13

| Chemical Composition | | Physical Properties | |
|---|---|---|---|
| ICP, CoO | 4.09 wt. % | B.E.T surface Area | 214 $m^2/g$ |
| $MoO_3$ | 16.35 wt. % | Pore Volume | 0.41 cc/g |
| NiO | 0.01 wt. % | Avg. Pore size | 76 Å |
| $Na_2O$ | 0.09 wt. % | Loading Density | 836 $kg/m^3$ |
| $Al_2O_3$ | Balance | Avg. Length | 1/20 inch |

400 cc of the catalyst was charged in a HDS pilot-plant facility for deep desulfurization and was subjected to pre-sulfiding in which dimethyl-disulfide was mixed at an amount of 1 wt % with an LGO. Then, the raw LGO "A" was introduced to the reactor and the product samples were collected for sulfur analyses at 3 different reaction temperatures. Before sampling the product, the catalyst bed was maintained for 24 hours at the same temperature for stabilization. Determination of catalyst activity with the adsorption-treated LGO "A-2" was done in the same manner. The results are given in Table 14, below.

TABLE 14

| | | | |
|---|---|---|---|
| Reaction Conditions | $H_2$ Partial Pressure, $kgf/cm^2$ | | 58.8 |
| | $H_2$/Oil Ratio, $Nm^3/Kl$ | | 170 |
| | LHSV, $hr^{-1}$ | | 1.88 |
| Rxn. Results, | Catalyst Volume, cc | | 400 |
| Product Sulfur | Feed | A | A-2 |
| | BAT 300 | 3,943 ppm | 2,547 ppm |
| | BAT 320 | 1,960 ppm | 1,298 ppm |
| | BAT 340 | 756 ppm | 325 ppm |

*BAT : Bed Average Temperature

As is apparent from the data, the level of sulfur reduction in the product improved substantially with the adsorption-pretreated feed at the same operating temperatures, compared to the feed that was not pretreated.

EXAMPLE 13

To examine and compare improved catalyst activity, deep desulfurization tests were carried out using 3 different NPC-removed feedstocks that were adsorption-treated with different RPAs: "B" of Example 1, and "B-2" and "B-3" of Example 11.

100 cc of the same catalyst as in Example 12 was charged in a high-pressure, continuous-type reactor, and was subjected to pre-sulfiding, in which dimethyl disulfide was mixed at an amount of 1 wt % with LGO. Deep HDS was conducted under the same conditions as in Example 12. After being stabilized at the same reaction temperature for 24 hours, the product sample was collected for sulfur analysis. The results are given in Table 15, below.

TABLE 15

| Product Sulfur Content Versus Reaction Temp. (wt.ppm) | | | |
|---|---|---|---|
| Feed | B | B-2 | B-3 |
| BAT 324 | 1503 | 756 | 470 |
| BAT 334 | 671 | 399 | 182 |
| BAT 344 | 301 | 99 | 63 |
| BAT 354 | 108 | 39 | 18 |

As illustrated in Table 15, the LGO feedstocks which were denitrified to the extent of 60% or higher by the adsorptive pretreatment of the present invention resulted in LGO products with sulfur content below 100 ppm (wt) at the same HIDS operating conditions that would have produced 300 ppm (wt) product sulfur for the same LGO feed.

EXAMPLE 14

100 cc of sample was taken from each of the products hydrodesulfurized at 334° C. described in Example 13 and analyzed for Saybolt color using a Minolta Digital Colorimeter CT-320. The results are given in Table 16, below.

TABLE 16

| Feedstock | B feed | B-2 feed | B-3 feed |
|---|---|---|---|
| Product Color | +12 | +20 | +18 |
| Product Sulfur | 671 ppm | 399 ppm | 182 ppm |

While product color degradation is often encountered in deep HDS, the adsorption pretreated feed significantly improved product color, as shown in Table 16. Such results suggest that deep HDS after adsorptive pretreatment of the present invention can bring about a substantial improvement in the product color as well as to the product sulfur content.

EXAMPLE 15

Deep HDS reaction tests were carried out with the feedstocks "A" and "C" of Example 1 and the NPC-removed LGOs "A2" and "C-2" of Example 11.

The same high pressure, continuous type reactor and catalyst described in Example 12 were used and the results are given, together with the operating conditions, in Table 17, below.

TABLE 17

| | | | | | |
|---|---|---|---|---|---|
| Rxn. Condition | $H_2$ Partial Pressure, kgf/cm$^2$ | | | 40.0 | |
| | $H_2$/Oil Ratio, $Nm_3$/Kl | | | 250 | |
| | LHSV, hr$^1$ | | | 1.35 | |
| Rxn. Results, | Catalyst Volume, cc | | | 100 | |
| Product sulfur, ppm | Feed | A | A-2 | C | C-2 |
| | BAT 324° C. | 1,348 | 779 | 1,355 | 846 |
| | BAT 334° C. | 684 | 281 | 774 | 426 |
| | BAT 334° C. | 296 | 155 | 355 | 180 |
| | BAT 354° C. | 115 | 40 | 158 | 75 |

Regardless of the difference in boiling points, sulfur content and nitrogen content of LGO, similar deep HDS improvements were obtained.

EXAMPLE 16

A deep HDS reaction test was carried out for the NPC-removed LGO "B-SX", prepared by solvent extraction in Example 9, under the same deep HDS conditions and employing the reactor described in Example 12. The is results are given in Table 18, below.

TABLE 18

| | | |
|---|---|---|
| Feedstock | Nitrogen, ppm (wt) | 57 |
| | Sulfur, ppm (wt) | 15,400 |
| Product Sulfur, ppm (wt) | BAT 334° C. | 680 |
| | BAT 344° C. | 279 |
| | BAT 354° C. | 118 |

The purpose of this example was to examine whether identical or similar effects could be attained by other NPC removal methods such as solvent extraction. The LGOs obtained in Example 9 were found to have a similar effect improving the HDS catalyst activity compared to the LGOs obtained by adsorption if the nitrogen removal ratios are the same. Therefore, the nitrogen removal ratio of the solvent extraction had the same effect as adsorption proposed in the previous examples. The solvent extraction could well be one of the pretreatment methods for deep HDS. However, an excessive quantity of solvent was needed to achieve the same nitrogen removal ratio as obtained by the adsorption. In fact, solvent extraction would require two or more distillation columns for solvent recovery, of which capacities could be as large as the subsequent deep HDS process. The solvent extraction method is, therefore, disadvantageous in operation and investment costs. If only a small amount of feedstock is to be treated with solvent extraction, such disadvantage can be overcome with suitable solvent. Such commercial disadvantage, however, does not limit the scope of the present invention.

EXAMPLE 17

A series of tests were carried out to examine the deep HDS effect of NPC-removed LCO.

At first, the LCO feedstock "D" was mixed with feedstock "B" at a volume ratio of 3:7, followed by subjecting the mixtures to deep HDS. The same catalyst and HDS conditions as in Example 12 were used. The NPC-removed LCO "D-SX", prepared by solvent extracton in Example 11, was also mixed with feedstock "B" at a volume ratio of 3:7, followed by subjecting the mixtures to deep HDS. The results are given in Table 19, below.

TABLE 19

| | Product S Contents | |
|---|---|---|
| Reaction BAT | Feed B 70 v. % + Feed D 30 v. % | Feed B 70 v. % + Feed D-SX 30 v. % |
| @334° C. | 2,449 ppm S | 1,859 ppm S |
| @344° C. | 1,649 ppm S | 1,201 ppm S |
| @354° C. | 1,060 ppm S | 749 ppm S |
| @364° C. | 665 ppm S | 393 ppm S |

Even in the case that cycle oils were added up to 30% of the feedstock, significant deep HDS improvements resulted, which could be ascribed to the removal of NPC. This is believed to have some economic significance to refinery operations that desulfurize middle distillates with a high portion of cycle oil in the feed.

COMPARATIVE EXAMPLE 18

A series of experiments were conducted to investigate the difference between U.S. Pat. No. 5,454,933 and the present invention in the following aspects: adsorbent regenerability, RPA and by-product amount. To make a valid comparison, an adsorbent, of which surface features were closed to that of adsorbent used in the disclosed invention, Filtrosorb 400, were carefully selected. BET properties of the two adsorbents are shown in Table 20, below.

TABLE 20

| BET Property | Activated Carbon suggested by U.S. Pat. No. 5,454,933 | Activated Carbon, DARCO |
|---|---|---|
| Surface Area $m^2/g$ | 800~1200 | 627 |
| Pore Size Å | 20~100 | 43.5 |

The adsorption/desorption procedure was as follows.

1) Activated carbon (ACROS organics, DARCO 20–40 mesh) was dried 6 hours at 150° C.

2) 40 cc of dried activated carbon was loaded in the inner tube of the concentric glass column and the activated carbon bed was maintained at 90° C. by circulating hot water through the outer jacket of the concentric tube.

3) 250 cc of toluene was fed at a flow rate of 8 cc/min into the adsorbent bed.

4) Upon completion of Step 3), 400 cc of deep hydro-desulfurized LGO, which had been produced from the LGO HDS process of SK Corporation and contained 240 ppm (wt) sulfur, was introduced at a flow rate of 15 cc/min.

5) The first 75 cc of the product mixture of LGO and toluene, which is equivalent to 35 cc of LGO, was collected and separated from the toluene by a rotary evaporator, keeping the remnant as T1.

6) The rest of the product mixture was collected and separated from the toluene by rotary evaporator, keeping the remnant as T2.

7) Upon completion of Step 4), 250 cc of toluene was introduced to regenerate the activated carbon at a flow rate of 8 cc/min.

8) The sulfur contents of "T1" and "T2" were analyzed by an ANTEK Sulfur analyzer.

9) The procedure from steps 4) to 8) was repeated once more.

10) The procedure from steps 4) to 8) was repeated three more times except Step 4), in which 100 cc of deep hydro-desulfurized LGO was introduced instead of 400 cc.

The results are given in Table 21.

TABLE 21

| No. of regeneration | 0 | 1 | 2 | 3 | 4 |
|---|---|---|---|---|---|
| T1, cc | 35 | 35 | 35 | 35 | 35 |
| RPA | 0.88 | 0.88 | 0.88 | 0.88 | 0.88 |
| Desulfurization, % | 80 | 64 | 66 | 47 | 48 |
| T1 + T2, cc | 400 | 400 | 100 | 100 | 100 |
| RPA | 10 | 10 | 2.5 | 2.5 | 2.5 |
| Desulfurization, % | 26 | 23 | 55 | 43 | 42 |
| Extract, gram | 33.0 | 32.3 | 32.1 | 31.7 | 32.4 |
| Ratio of Extract over Feed (w/w %). | 9.7 | 9.5 | 37.8 | 37.3 | 38.1 |

*RPA: Ratio of Product volume to Adsorbent volume per one cycle

Since Filtrosorb 400 was not available, DARCO activated carbon, having physical properties similar to Filtrosorb 400, was used in the experiment. For RPA of 0.88, the adsorbent removes up to 80% of sulfur compounds from a deep HDS-treated LGO stream. The adsorbent, however, tends to lose its adsorption effectiveness as desorption is repeatedly conducted. Therefore, it is questionable whether the disclosed invention can be continuously operable with 1~1.75 RPA, even with Filtrosorb 400. The disclosed invention of U.S. Pat. No. 5,454,933 does not provide examples describing continuous operation, where adsorption and desorption are conducted at more than one cycle.

As given in Table 21, approximately 40% of feed was converted to the byproduct at RPA of 2.5. Should Filtrosorb 400 be much more selective in adsorbing sulfur compounds, byproduct generation at RPA of 1~1.75 could be considerably higher. The byproduct cannot be used other than as a blending stock for high sulfur heavy oils, and this could be greatly disadvantageous for the disclosed invention of the patent from an economic standpoint.

EXAMPLE 19

The NPC obtained as in Example 4 was added to a diesel fuel "LL" with poor lubricity as much as 100 ppm (wt) and 300 ppm (wt), respectively. The prepared samples were then subjected to lubricity tests by the use of an HFRR (high frequent reciprocating rig), which is a standard ISO diesel fuel lubricity measuring instrument. The results are given in Table 22, below.

TABLE 22

| Amount added ppm (wt) | 0(Base) | 100 | 300 |
|---|---|---|---|
| Avg. Abraded Diameter, HFRR | 588 | 498 | 415 |

The above results indicate that the NPC, which is a by-product of the adsorption pretreatment process, can be used as an effective diesel lubricity additive for ultra-low sulfur diesel fuel, which tends to have very poor lubricity.

The pretreatment process of the present invention, thus, not only improves subsequent catalytic processes to produce ultra low sulfur fuels but also provides solutions to the lubricity degradation problems of the fuels by using the by-product as a lubricity additive.

EXAMPLE 20

Tests were carried out to examine how the NPC removal influenced the emission characteristics of the produced diesel fuel. NPC-removed diesel and "regular" diesel with the same sulfur level were subjected to an emission test and the test was conducted as follows:

1) The feedstock "A" was subjected to deep HDS at 356° C. under the same conditions as in Example 12, to produce desulfurized LGO, which was designated as "A-em-1".

2) The feedstock "A" was subjected to the adsorption pretreatment to remove NPC in the same way as in Example 6, and then, was subjected to deep HDS reaction at 339° C. to produce desulfurized LGO, which was designated as "A-em-2".

3) Commercially available kerosene with a sulfur content of 10 ppm (wt) was blended with the "A-em-1" and "A-em-2" at 30% level to prepare emission test fuels which had similar distillation characteristics comparable to that of commercially available diesel fuels and designated "A-em-1-D" and "A-em-2-D", respectively.

4) The above two samples were tested in a diesel engine along with the reference fuel to stabilize the engine. Commercial diesel fuel (SK Diesel) was used as a reference fuel. The characteristics of the samples are shown in Table 23, below.

5) The emission test was carried out with a bus diesel engine having a displacement of 11,050 cc, such as sold by Daewoo Motors Co. Ltd., Korea, identified as Model D2366. The amount of PM emission was measured according to the D-13 mode, which is an emission test mode for heavy-duty diesel vehicles in Korea. In addition, smoke was measured with the 3 samples according to smoke 3 mode. Details and measurements are given in Tables 24 and 25, respectively.

6) To minimize errors due to environmental changes, the test was conducted continuously. The engine was checked for its repeatability using a reference fuel before and after the test session. In addition, 4 pre-tests were carried out with the same reference diesel fuel to evaluate the reproducibility of an MDT (Mini Dilution Tunnel) used for PM measurement and an exhaust gas analyzer.

TABLE 23

| Characteristics | SK Diesel | A-em-1-D | A-em-2-D |
|---|---|---|---|
| Gravity 15/4° C. | 0.8374 | 0.8218 | 0.8209 |
| ASTM D86, ° C. | | | |
| IBP | 152 | 159 | 165 |
| 10% | 190 | 200 | 204 |
| 50% | 259 | 278 | 282 |
| 90% | 344 | 351 | 353 |
| 95% | — | 368 | 370 |
| EP | 376 | 382 | 378 |
| Residue, vol. % | 0.8 | 1.6 | 1.5 |
| Flash Point, ° C. | — | 63 | 63 |
| S ppm (wt) | 330 | 220 | 220 |
| N ppm (wt) | — | 23 | 8 |
| 10% C residue, wt % | 0.10 | 0.04 | 0.02 |

*SK Diesel: commercial SK corporation diesel products

TABLE 24

| Operating conditions by Test Modes | | | |
|---|---|---|---|
| D-13(PM Measurement) | | | |
| Mode | Engine RPM | % Load | Wt. factor |
| 1 | Idle | — | 025 |
| 2 | 1920 | 10 | 0.08 |
| 3 | 1920 | 25 | 0.08 |
| 4 | 1920 | 50 | 0.08 |
| 5 | 1920 | 75 | 0.08 |
| 6 | 1920 | 100 | 0.25 |
| 7 | Idle | — | 0.25 |
| 8 | 3200 | 100 | 0.1 |
| 9 | 3200 | 75 | 0.02 |
| 10 | 3200 | 50 | 0.02 |
| 11 | 3200 | 25 | 0.02 |
| 12 | 3200 | 10 | 0.02 |
| 13 | Idle | — | 0.25/3 |
| Smoke 3 (Smoke measurement) | | | |
| Mode | Engine RPM | % Load | |
| 1 | 1000 | 100 | |
| 2 | 1320 | 100 | |
| 3 | 2200 | 100 | |

*RPM at maximal engine output: 3200 rpm
60% of the RPM at maximal engine output: 1920 rpm

TABLE 25

| Test Items | Total PM (g/KW-h) | SOF (g/KW-h) | Sulfate (g/KW-h) | $No_x$ (g/KW-h) | Smoke (%) |
|---|---|---|---|---|---|
| A-em-1-D | 0.766 | 0.051 | 0.007 | 3.954 | 50 |
| A-em-2-D | 0.596 | 0.040 | 0.005 | 2.671 | 48 |
| Improvement, % | 22 | 21 | 28 | 33 | 4 |

SOF (Soluble Organic Fraction)

As shown in Table 25, the NPC-removed-then-deep-hydrodesulfurized diesel fuel showed 22% lower level of PM emission compared to the other fuel at the same sulfur level. Such an improvement in emission characteristics likely resulted from removal of precursor material for PM; such precursor material might well be removed as part of NPC. Such emission characteristics make the pretreatment process of the present invention even more attractive because it can produce cleaner diesel fuels, which are low in sulfur content as well as emit less pollutant compared to other diesel fuels with the same sulfur contents.

Although the present invention may be applied to various catalytic processes for producing hydrocarbon fuels, it is more preferably applied to upstream of deep HDS processes manufacturing kerosene and diesel fuels to improve effectiveness of the HDS processes and qualities of the products therefrom.

Due to the ever-tightening stringent environmental regulations, refineries call for effective and economic deep desulfurization technologies to produce cleaner diesel fuels. The present invention suggests a simple but efficient pretreatment process that will enable a conventional HDS process to economically produce ULSD from high-sulfur LGO feedstock.

In addition, the present invention provides such advantages as extending the catalyst life, reducing hydrogen consumption and saving operation cost by making the best use of low-quality feedstocks.

Furthermore, for the same sulfur content level, adsorption-treated diesel fuel shows better emission characteristics than conventional diesel fuel. When combusted, adsorption-treated diesel fuel emits lower amounts of PM and NOx, two of the most strictly regulated pollutants, compared to conventional diesel fuel. The color of diesel fuel is improved because HDS reaction temperature is decreased and color body precursor level gets substantially reduced in the pretreatment process.

Operating conditions of the pretreatment process are close to ambient temperature and pressure. In addition, the pretreatment process can treat a hydrocarbon stream at higher space velocities than HDS processes, and therefore the size requirement becomes substantially smaller than other conventional reaction units. The investment cost of the pretreatment process is estimated to be approximately 10% of that of HDS process. Since the pretreatment process uses common adsorbent and solvent without catalyst and hydrogen, the operating cost is also estimated to be around 10~20% of that of HDS process.

The present invention has been described in an illustrative manner, and it is to be understood the terminology used is intended to be in the nature of description rather than of limitation. Many modifications and variations of the present invention are possible in light of the above teachings. Therefore, it is to be understood that within the scope of the appended claims, the invention may be practiced otherwise than as specifically described.

What is claimed is:

1. A method of manufacturing hydrocarbon fuel, the method comprising: (a) removing natural polar compounds from a petroleum feedstock fraction prior to catalytically hydroprocessing the petroleum feedstock fraction to substantially decrease the concentration of natural polar compounds in the petroleum feedstock fraction, the petroleum feedstock fraction having a boiling point in the range from 110° C. to 560° C., and (b) catalytically hydroprocessing the petroleum feedstock fraction to produce a hydrocarbon fuel.

2. The method of claim 1, wherein the hydrocarbon fuel has a boiling point in the range of 110° C. to 400° C. and a sulfur content less than 500 ppm (wt).

3. The method of claim 1, wherein the hydrocarbon fuel has a boiling point in the range of 110° C. to 400° C. and a sulfur content less than 50 ppm (wt).

4. The method of claim 1, wherein the boiling point of the petroleum feedstock fraction is in the range from 200° C. to 400° C.

5. The method of claim 1, wherein the petroleum feedstock fraction resulting from step (a) contains greater than a 30% reduction in nitrogen content, greater than a 0.5% reduction in sulfur content, and greater than a 60% reduction in total acid number, as compared to the original feedstock fraction.

6. The method of claim 1, wherein the natural polar compounds comprise between 5.0 and 50% (wt) oxygen-containing compounds, between 5.0 and 50% (wt) nitrogen-containing heterocyclic compounds, and sulfur content in the range of 0.1 to 5.0% (wt).

7. The method of claim 1, wherein the natural polar compounds removed from the petroleum feedstock fraction constitute between 0.1 to 5.0% (wt) of the petroleum feedstock fraction.

8. The method of claim 1, wherein hydroprocessing is selected from the group of processes consisting of hydrodesulfurizing, hydrodearomatizing, mild hydrocracking, hydrocracking, or mixtures thereof.

9. The method of claim 1, wherein the natural polar compounds are removed from the petroleum feedstock fraction by solvent extraction.

10. The method of claim 9, wherein the petroleum feedstock contains heavy gas oils having a final boiling point over 400° C., fluidized catalytic cracking (FCC) cycle oil, and coker gas oil.

11. The method of claim 1, wherein the natural polar compounds are removed from the petroleum feedstock fraction by adsorption with one or more adsorbents.

12. The method of claim 11, wherein the adsorption occurs in two or more adsorption towers.

13. The method of claim 11, wherein the adsorption process occurs in a fluidized bed adsorption process or an ebullated bed adsorption process.

14. The method of claim 11, wherein the adsorbent is selected from the group consisting of activated alumina, acid white clay, Fuller's earth, activated carbon, zeolite, hydrated alumina, silica gel, ion exchange resin, and combinations thereof.

15. The method of claim 14, wherein the adsorbent is selected from the group consisting of silica gel, ion exchange resin, and combinations thereof.

16. The method of claim 15, wherein the adsorbent is silica gel, having a pore size ranging from 40 to 200 Å, a specific surface area ranging from 100 to 1000 $m^2/g$, and a pore volume ranging from 0.5 to 1.5 cc/g.

17. A method for improving the lubricity of diesel fuels, the method comprising adding natural polar compounds extracted from petrolic hydrocarbons having a boiling point in the range of 200° C. to 400° C.

18. The method as set forth in claim 17, wherein the natural polar compounds are concentrated by adsorption.

19. The method of claim 18 where adsorption is selected from the group of processes consisting of fixed bed adsorption using two or more adsorption towers, fluidizing bed adsorption, or an ebullated bed adsorption process.

20. The method of claim 19, wherein the adsorption process utilizes an adsorbent selected from the group consisting of activated alumina, acid white clay, Fuller's Earth, activated carbon, zeolite, hydrated alumina, silica gel, ion exchange resin and the combinations thereof.

21. The method of claim 20 wherein the adsorbent is silica gel which having a pore size ranging from 40 to 200 Å, a specific surface area ranging from 100 to 1,000 $m^2/g$, and a pore volume ranging from 0.5 to 1.5 cc/g.

22. The method as set forth in claim 18, wherein the natural polar compounds have a nitrogen content 50 times greater than that of the petrolic hydrocarbons and comprise greater than 10 wt % oxygen-containing organic acids and phenols.

* * * * *